US008822857B2

(12) United States Patent
Cho

(10) Patent No.: US 8,822,857 B2
(45) Date of Patent: Sep. 2, 2014

(54) HANDLE FOR DOORS OR PANELS, ESPECIALLY FOR VEHICLES

(75) Inventor: Yong-Sang Cho, Incheon (KR)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 473 days.

(21) Appl. No.: 12/998,975

(22) PCT Filed: Dec. 14, 2009

(86) PCT No.: PCT/EP2009/009102
§ 371 (c)(1),
(2), (4) Date: Jun. 20, 2011

(87) PCT Pub. No.: WO2010/072377
PCT Pub. Date: Jul. 1, 2010

(65) Prior Publication Data

US 2011/0254290 A1 Oct. 20, 2011

(30) Foreign Application Priority Data

Dec. 22, 2008 (DE) ..... 10 2008 064 212

(51) Int. Cl.
*H01H 9/04* (2006.01)

(52) U.S. Cl.
USPC ..... 200/302.1

(58) Field of Classification Search
USPC ..... 200/302.1, 5 A, 50.18, 61.44, 520, 556, 200/302.2, 302.3, 303, 329, 332.2, 333, 200/334, 343, 345
See application file for complete search history.

(56) References Cited

U.S. PATENT DOCUMENTS

2003/0122556 A1 7/2003 Sueyoshi et al.

FOREIGN PATENT DOCUMENTS

| | | |
|---|---|---|
| DE | 10020172 | 1/2001 |
| DE | 10331947 | 2/2005 |
| DE | 102008064212 | 6/2010 |
| EP | 1014405 | 6/2000 |

*Primary Examiner* — Edwin A. Leon
*Assistant Examiner* — Anthony R. Jimenez
(74) *Attorney, Agent, or Firm* — Horst M. Kasper

(57) ABSTRACT

The invention relates to a handle for doors or panels, especially on vehicles. An actuation element (10) is provided, such as a button or switch, which is integrated in the handle (50) and comprises an at least regionally elastic sealing element (30) and at least one dimensionally stable housing element (20). According to the invention, a button plate (21) having at least one sealing projection (22) is provided, wherein the sealing projection (22) can be operatively connected to the elastic sealing element (13) such that the sealing projection (22) penetrates into the material of the sealing element (30) at least regionally. Thus, the inside (13) of the actuation element (10) is sealed with respect to the outside (14).

15 Claims, 9 Drawing Sheets

HANDLE FOR DOORS OR PANELS, ESPECIALLY FOR VEHICLES

Figure 1:
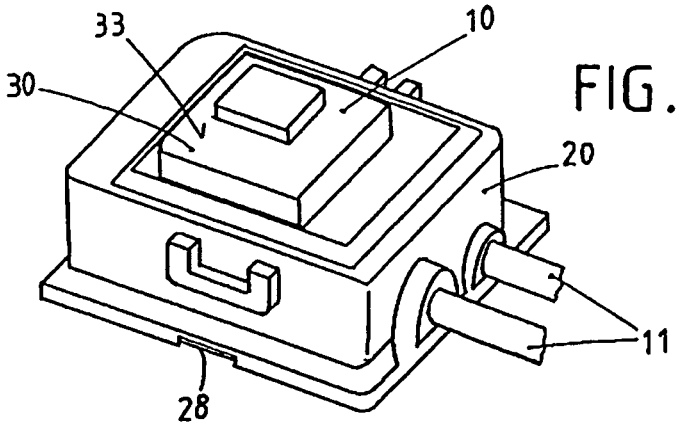

The invention concerns a handle for doors or panels, in particular at vehicles, of the kind indicated in the preamble of claim 1. Such handles are employed in particular in modern motor vehicles and serve here mostly for the opening or closing of the door or panel or, respectively, for the actuation of a closure mechanism.

The German printed patent document DE 103 31947 A1 describes such a handle. The handle includes a key switch, which is surrounded in regions by an elastic membrane and which is inserted in a shape stable housing. The housing and the membrane are generated by a multi component injection molding method. This method is however comparatively cost intensive. In addition it is not possible to lacquer the membrane of the pressure actuator, for example in the color of the vehicle. This is however frequently required for aesthetic reasons. At the same time, the device has also to meet the high requirements for sealing, which are important just in the vehicle region in order to allow a long lifetime and a good functional security of the device components. A securing sheet metal is necessary for the here presented handle, wherein the securing sheet metal operates as a counter support for the key switch. This security sheet metal is cast with the grouting mass at the end of the production process. The production costs are further increased by the security sheet metal. In addition it has to be considered during the entering of the grouting mass that no leaks are generated, since otherwise the functional capability of the key switch could be decreased.

It is therefore an object of the invention to avoid the recited disadvantages and to create a handle of the kind described in the preamble of claim 1, wherein the electronic integrated into the handle is protected against soiling and humidity, wherein the components of the handle visible toward the outside can be lacquered and coated as desired, and which handle is nevertheless simple and cost favorable in the production. This object is resolved by the characterising features of claim 1, which have the following particular importance.

A key board plate with at least one sealing projection is provided. This sealing projection can enter into such a connection with the elastic sealing element, and that the sealing projection at least in certain regions penetrates into the material of the sealing element. In this manner the interior of the actuating element is sealed relative to the outer side. In contrast to the state of the art, here the use of a grouting mass for sealing purposes is not any longer required. Also the key board plate can be produced substantially more cost favorable as the security sheet metal employed up to now. While the security sheet metal serves only as a counter support for the key board switch, the key board plate itself already seals the interior of the actuating element.

According to a particular preferred embodiment there is also provided a housing floor, which secures the key board plate in its sealing position, wherein the sealing operating connection exists between the sealing element and the sealing projection. The key board plate can then also itself serve as a counter support for the actuating element in this configuration. The operating connection between the sealing element and the sealing projection is preferably obtained by the mounting of the housing floor in order to simplify the mounting. This will be explained in more detail below. Further advantages and embodiment examples result from the following description and the sub claims and the drawing. The subject of the invention is illustrated in the drawings.

Figure 2:
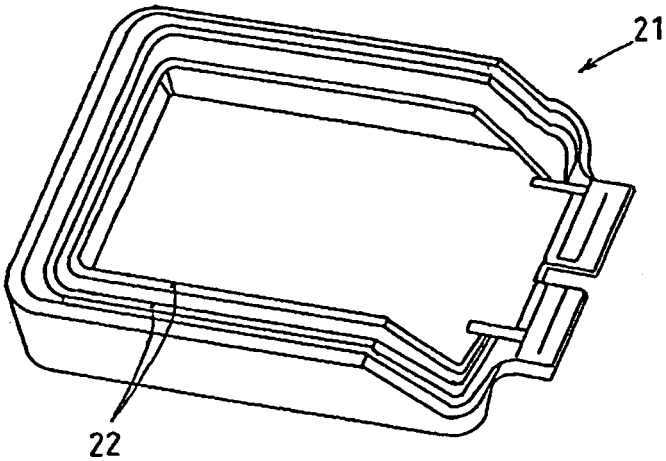
Figure 3:
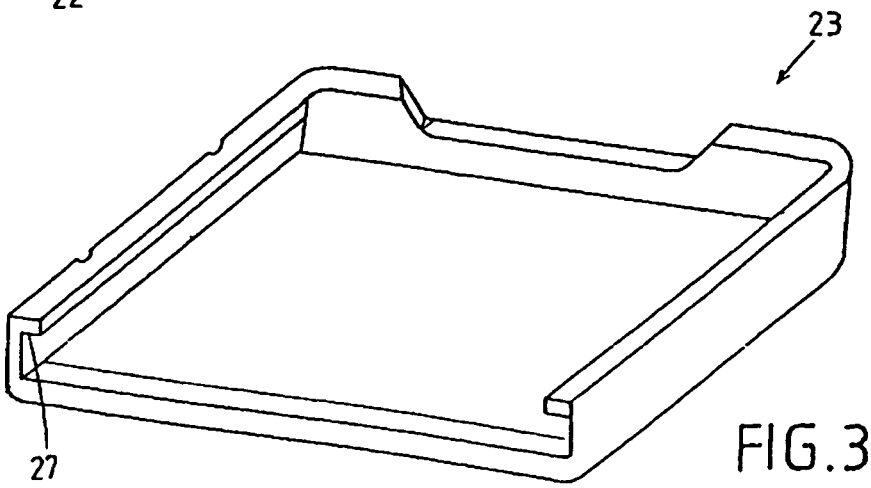
Figure 4A:
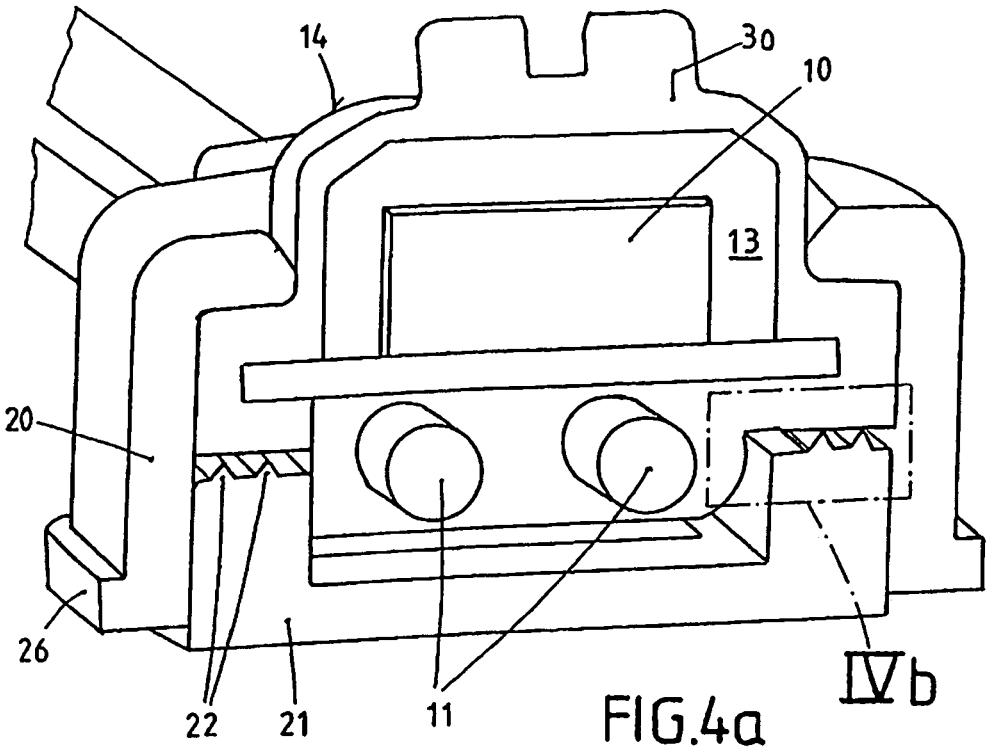
Figure 4B:
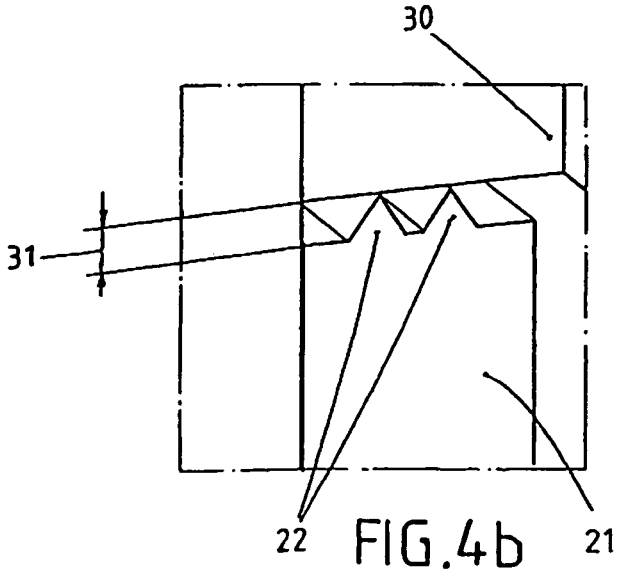

There is shown in:

FIG. 1 an actuating element according to the invention with a housing element, FIG. 2 shows an embodiment of the key board plate, FIG. 3 shows an embodiment of a housing floor, FIG. 4*a* shows an actuating element with a housing element and the key board plate prior to the mounting of the housing floor, FIG. 4*b* shows an enlarged section of FIG. 4*a,*

Figure 5A:
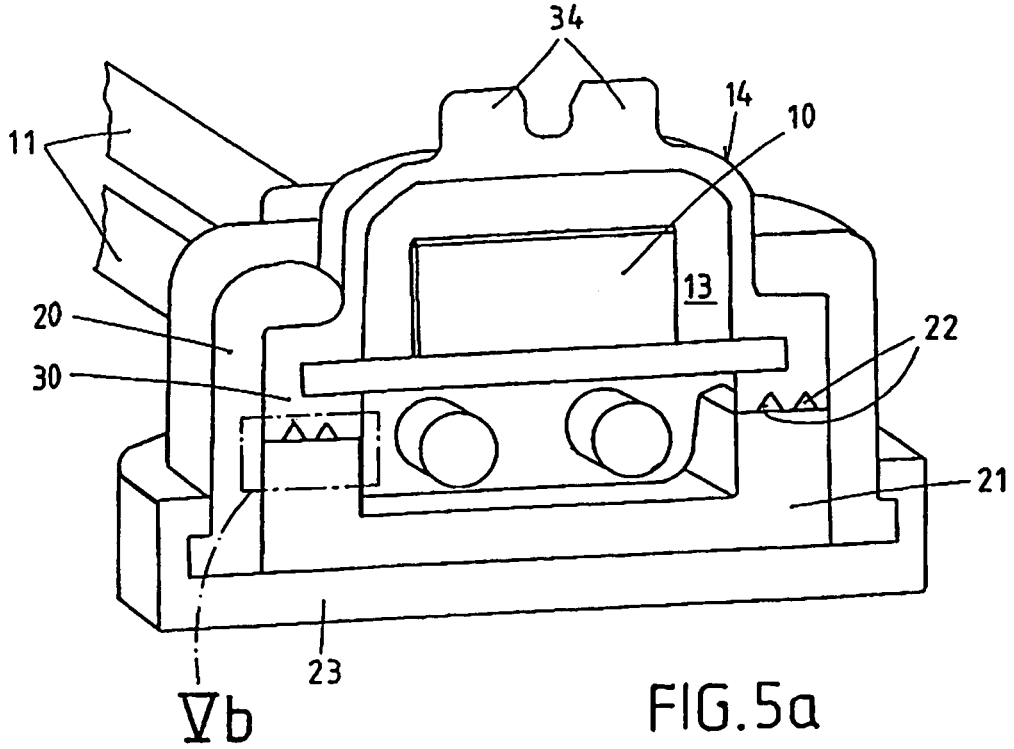
Figure 5B:
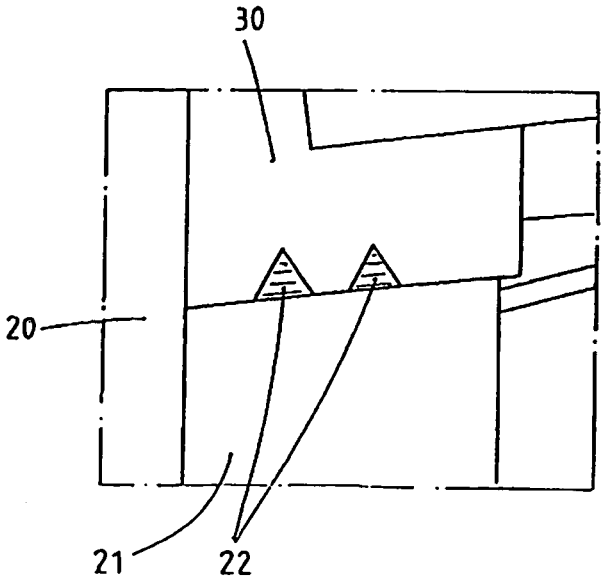

FIG. 5*a* shows the elements of FIG. 4*a* after the mounting of the housing floor, FIG. 5*b* shows an enlarged section of the FIG. 5*a,*

Figure 6:
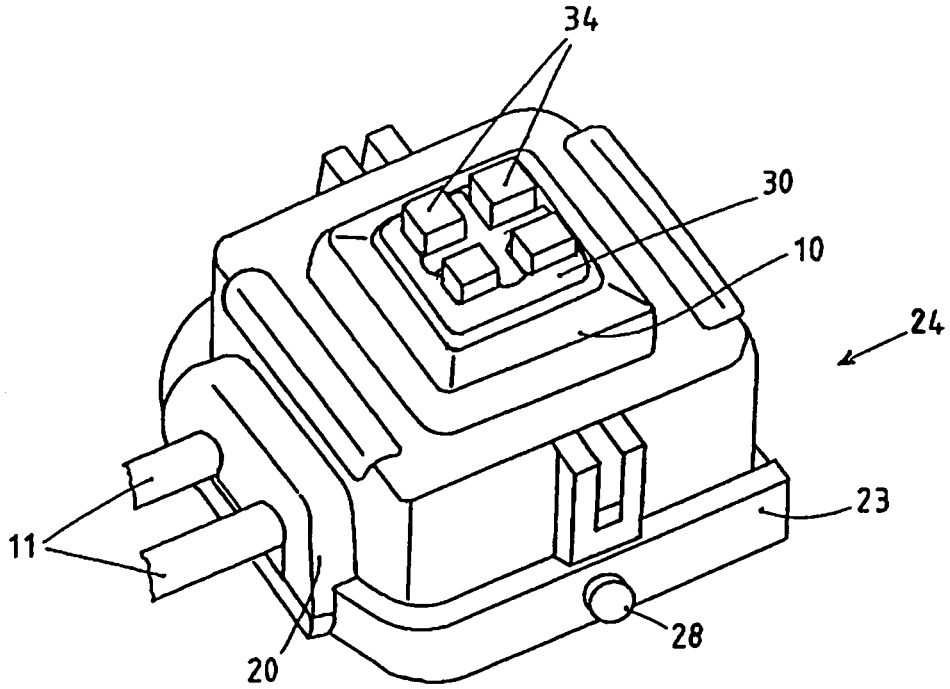
Figure 7:
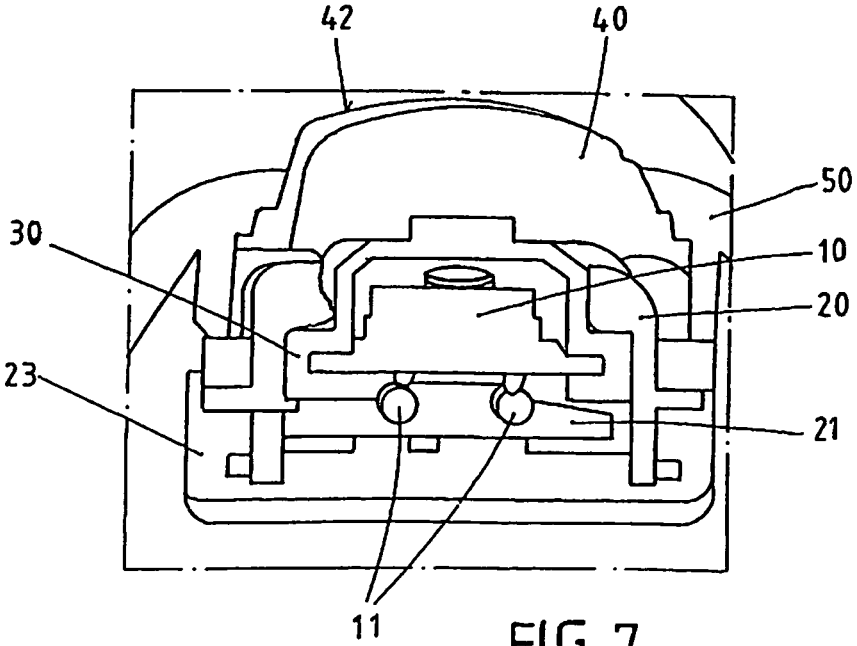
Figure 8:
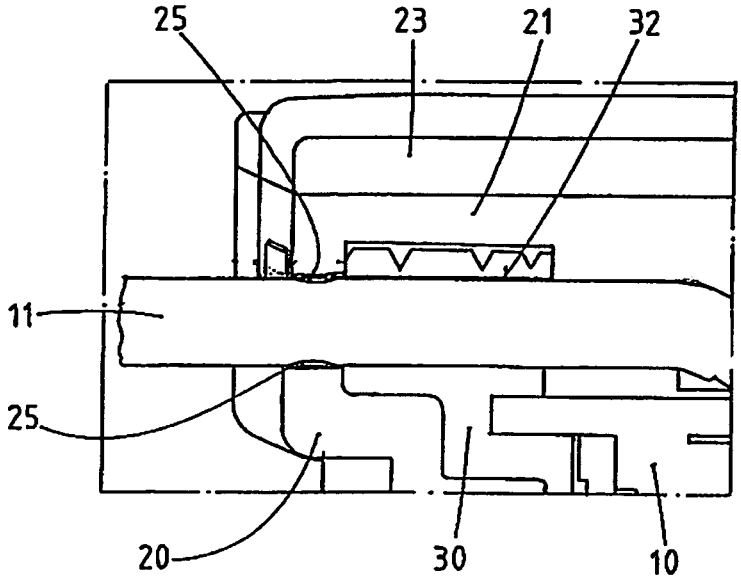
Figure 9A:
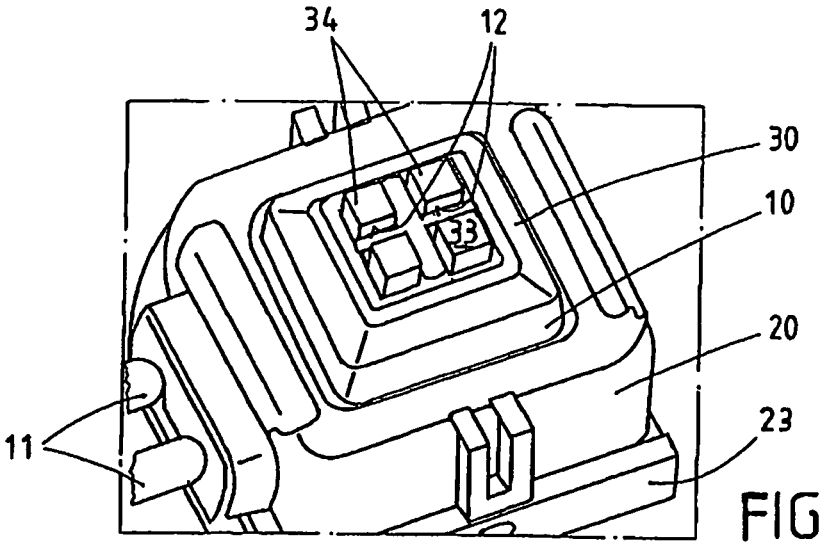
Figure 9B:
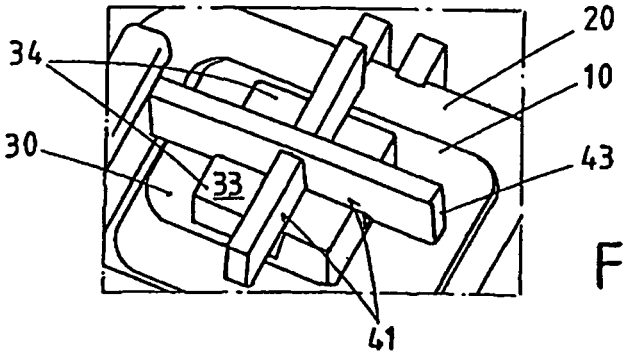
Figure 10:
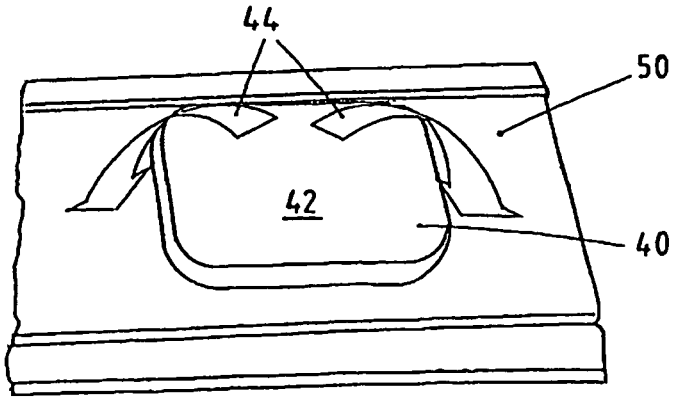
Figure 11A:
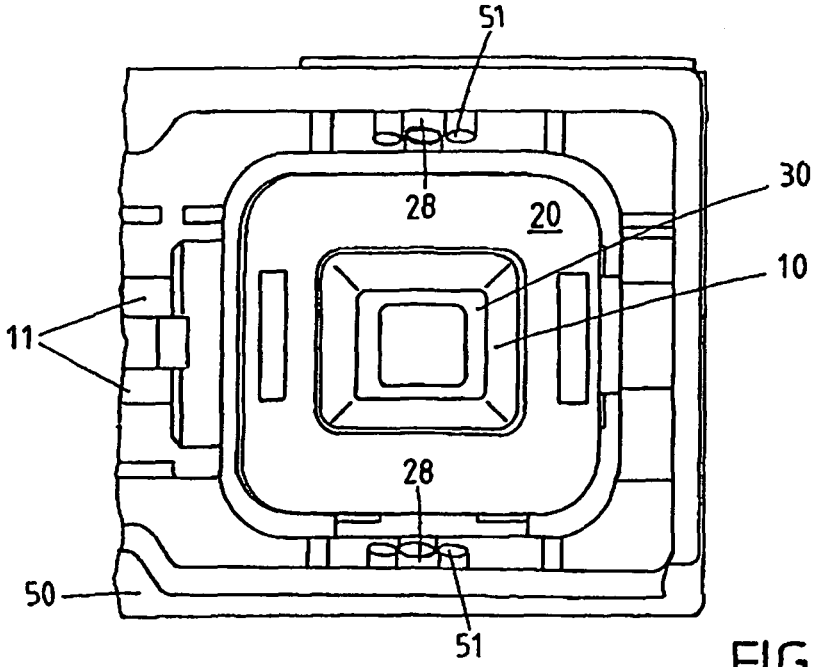
Figure 11B:
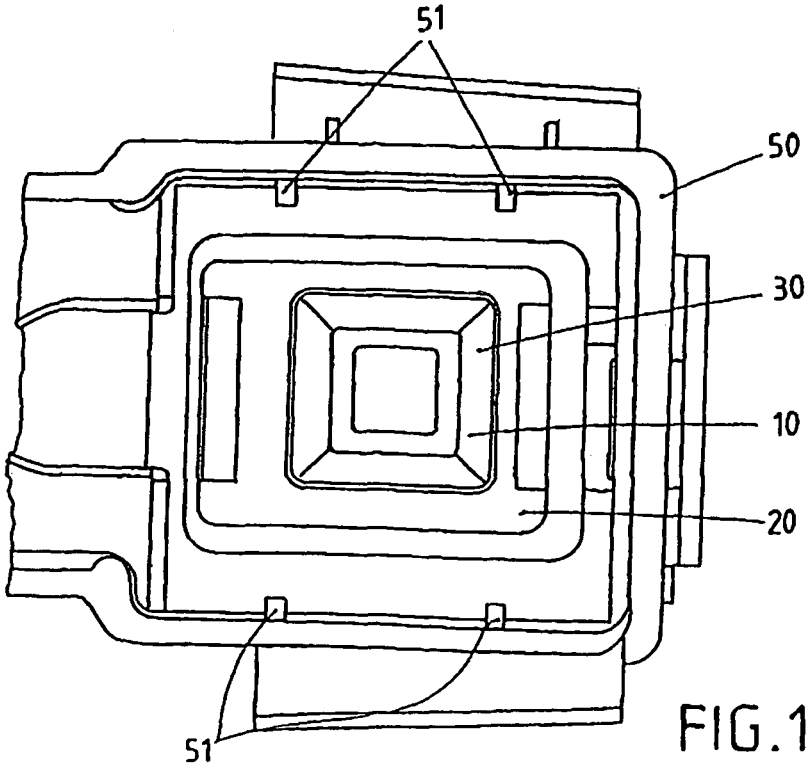

FIG. 6 the finished mounted device unit according to FIG. 5*a* in a perspective view, FIG. 7 a sectional view of a device unit according to the present invention incorporating an actuator in a handle, FIG. 8 holding the electrical conductors according to the invention, FIG. 9*a* the device unit according to the invention in a perspective view, FIG. 9*b* an elevational view according to FIG. 9*a* with a stabilization component, FIG. 10 the element of FIGS. 9*a* and 9*b* with an actuator mounted in a handle, FIG. 11*a* the device unit mounted in the handle in a top planar view, FIG. 11*b* another embodiment of the device components of FIG. 11*a,*

Figure 12A:
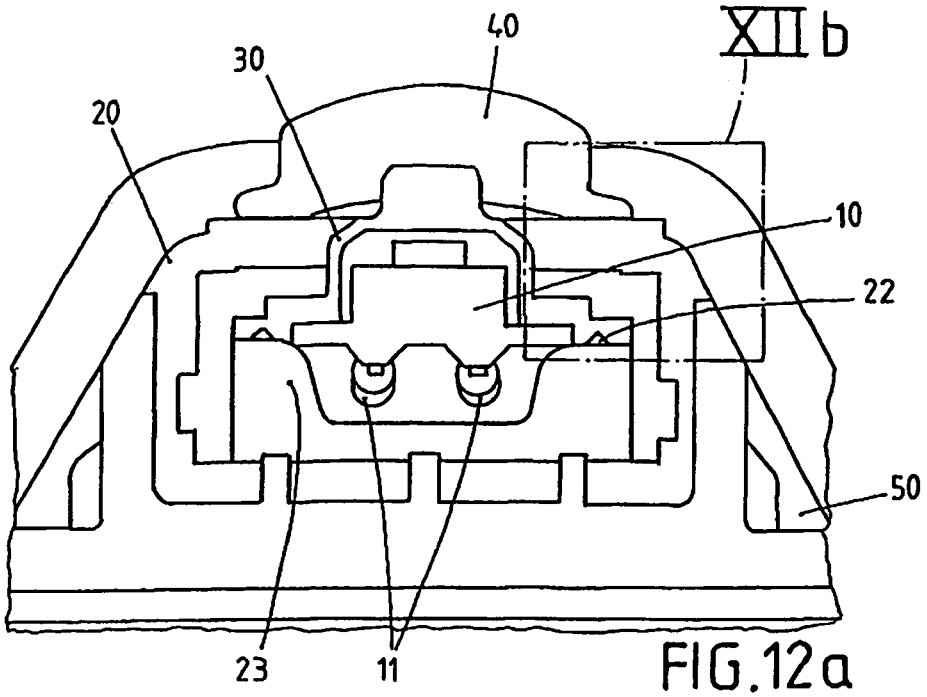
Figure 12B:
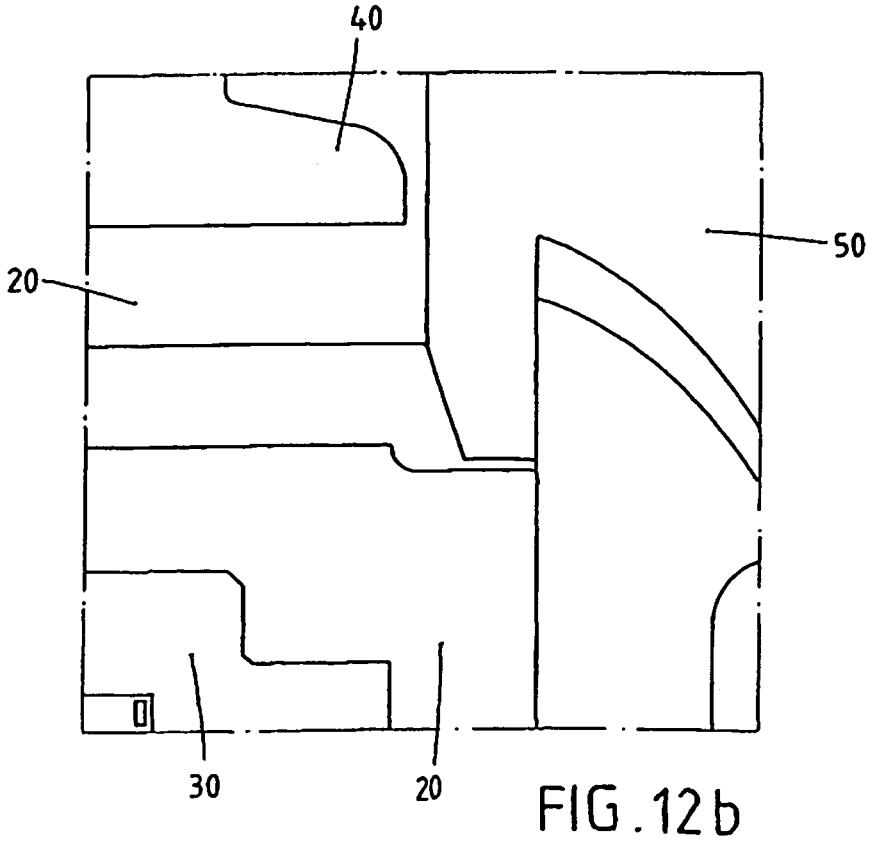

FIG. 12*a* the incorporated device unit with handle and actuator in a sectional view, FIG. 12*b* an enlarged section from FIG. 12*a,*

Figure 13A:
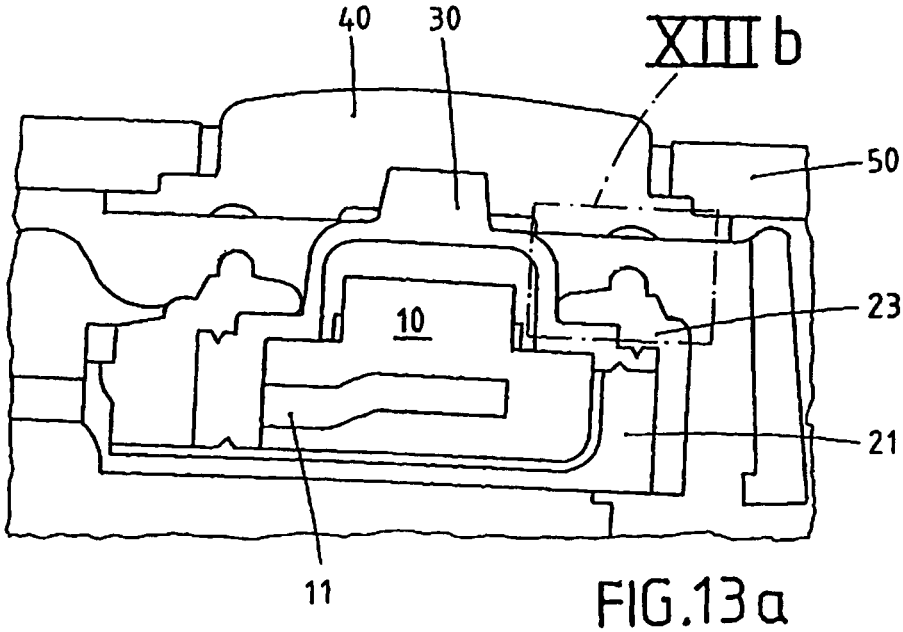
Figure 13B:
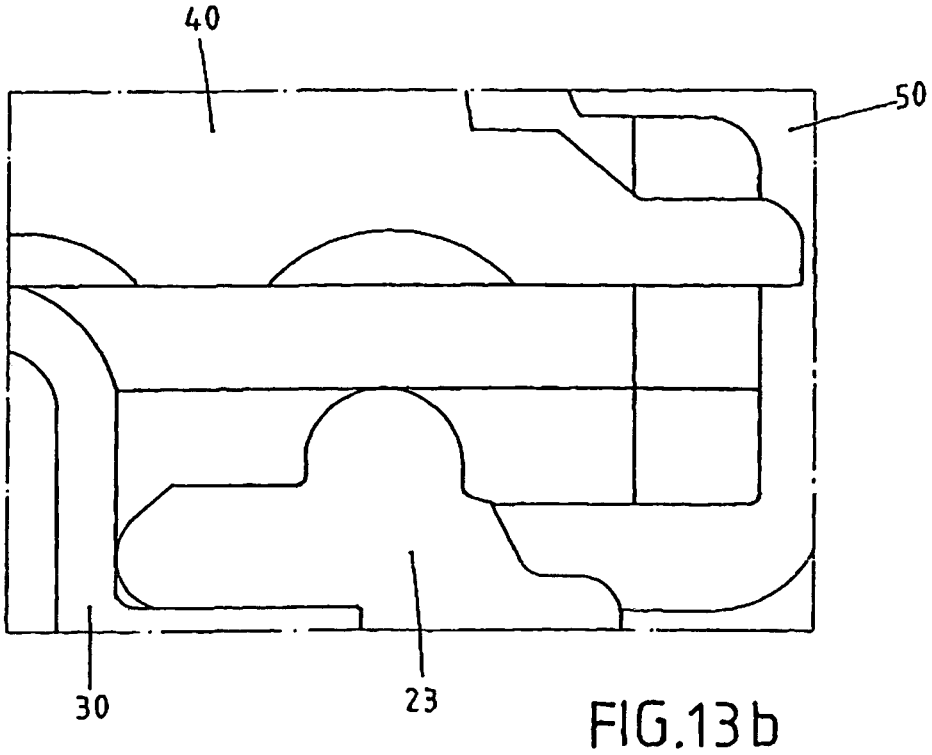

FIG. 13*a* a further section through the device unit with actuator incorporated into the handle, FIG. 13*b* an enlarged section from FIG. 13*a*.

The FIG. 1 shows an actuating element 10 with a housing element 20. Only the sealing element 30 of the actuating element 10 is visible in this view. In addition, one recognizes the electrical conductors 11, which can further guide the signals generated by the actuating element 10 to a control unit.

FIG. 2 shows a preferred embodiment of a key board plate 21. This key board plate 21 consists of a form stable plastic and has two sealing projections, which are formed as circulating ribs 22. If the circulating ribs 22 penetrate into the material of the sealing element 30, a sealed connection is generated in this way, wherein the sealed connection seals the interior 13 of the actuating element 10 relative to the outer side 14.

The housing floor 23 shown in FIG. 3 secures the connection between key board plate 21 and sealing element 30. The housing floor 23 is also formed by form stable plastic material.

The cooperation of the previously described device components is best visible from the FIGS. 4*a* and 4*b* as well as 5*a* and 5*b*. The FIGS. 4*a* and 4*a* (translator's remark: should be 4*b*) show the precedingly recited device components prior to the mounting of the housing floor 23. The sealing projections are formed as ribs 22 already touch the sealing element 30 of the actuating element 10. However the slot 31 still exists and the sealing projections 22 still do not penetrate the material of the sealing element 30. The sealing projections 22 are brought into operational connection with the sealing element 30. Here the ribs 22 penetrate into the material of this sealing element 30 in order to obtain the sealing connection.

One recognizes further that the housing floor 23 is held and supported at the housing element 20, wherein the housing floor 23 simultaneously secures the operational connection generated between the sealing element 30 and the sealing projections 22. The housing floor 23 can be additionally snapped-in or making a clip connection at the housing element 20. Also other connection possibilities are here conceivable. During the assembly of the present housing floor 23, the housing floor 23 was only shifted onto the housing element 20, wherein the guides 26 at the housing element 20 cooperate with counter guides 27 at the housing floor 23.

The finished mounting device unit 24 is then illustrated in FIG. 6. The housing floor 23 is held and supported at the housing element 20. The electrical conductors 11 as well as the sealing element 30 of the actuating element 10 are otherwise still accessible from the outside. Furthermore, the clip connection element 28 is recognizable at the housing floor 23, wherein the importance of the clip connection element 28 will be explained in more detail below.

FIG. 7 shows the mounted device unit 24 disposed in the handle 50 in a sectional view. Also the actuator 40 can be recognized, which actuator 40 is disposed above the sealing element 30 of the actuating element 10 as shown in FIG. 7. The actuating element 10 is released by a manual actuation of the actuator 40 by intermediate switching of the sealing element 30. The electrical conductors 11 leading away from the actuating element 10 can then further lead the signal to a control unit not represented here in more detail. The interior 13 of the actuating element 10 is sealed relative to the outside 14 such that no humidity can penetrate into the actuating element 10 and render it non-operative.

Both the actuator 40 as well as the housing element 20, the key board plate 21 and the housing floor 23 are here made of a form stable plastic material. This is particularly simple and cost favorable in the production. For example, the previously recited elements can be produced by an injection molding method.

FIG. 8 shows now a possibility of holding and supporting the electrical conductors 11. The holding means 25 is formed here by the key board plate 21 and the housing element 20. The electrical conductors get quasi jammed in the holding means 25. This avoids a possible motion of the electrical conductors 11. This contributes also to the sealing of the device unit 24. The electrical conductors 11 are led through the sealing element 30. If one would allow stronger motions of the electrical conductors 11, then humidity could pass into the interior 13 of the actuating element 10 through the openings 32 in this sealing element 30, wherein the openings 32 are provided for the electrical conductors 11. However, precisely this movability of the electrical conductors 11 is avoided by the holding means 25 of the electrical conductors 11. The interior 13 of the actuator element 10 is thus protected also against a penetration of humidity through the openings 32.

During assembly of the actuator 40, an unintentional flip and/or shifting motions 44 of the actuator 40 can occur, whereby a secure actuation cannot any longer be assured. However, if an advantageous construction of the actuator 40 or, respectively, of the sealing element 30 are furnished, then an unintentional shifting 44 of the actuator 40 can be avoided. The possibilities for this are illustrated in the FIGS. 9*a*, 9*b* and 10. The upper side 33 of the sealing element 30 exhibits for this purpose four cams 34. Counter holding means 12 are disposed at the cams 34, wherein the counter holding means 12 can cooperate in a mounted state with holding means 41 of the actuator 40. The holding means 41 can here be disposed at a stabilization device part 43 as shown in FIG. 9*b*. This stabilization device part 43 can be performed as a single piece with the actuator 40 or with the actuator element 10 or, respectively, its sealing element 30. This stabilization device part 43 exhibits the holding means 41 in the present embodiment example. Of course it is also possible, for example in case of a single piece construction of the stabilization device part 43 with the actuator element 10, to furnish the counter holding means 12 at the stabilization device part. The shifting motion or flip motion 44 of the actuator 40 mounted in the handle 50 is thereby prevented.

It is particularly preferred when the actuator 40 exhibits several actuating regions in the area of its surface 42. These actuating regions can then trigger different functions at the vehicle. For example the handle and/or the actuating element can be furnished for interacting with a lock system in the vehicle and thereby performing an opening, closing, bolting and/or unbolting of a lock at the door or, respectively, of the flap of the vehicle, by way of for example, different actuating regions can be furnished for "opening", "closing", "comfort closing", or the like. For example it can be understood that "comfort closing" means that in addition to the doors also all windows are closed and bolted. Similarly, an owned actuating region at the actuator 40 at a vehicle door can be furnished for opening the flap of the luggage compartment.

The most different actuation regions can thereby be furnished through different actuating regions at an actuation element 10 or also by the employment of several actuating elements 10.

The FIGS. 11*a* and 11*b* now show the device unit 24 in the mounted state in the handle 50. A clip connection 51 serves here for determining the device unit 24. The clip connection 51 is produced for example by employing clip elements 28, which are disposed in the present case at the housing floor 23. It is of course also possible to furnish the clip elements 28 at the housing element 20 or, respectively, at the handle 50. How many clip elements 28 or, respectively, clip connections 51 are furnished and how these are arranged depends on the concrete individual application situation.

A further advantage of the invention can be recognized in FIGS. 12*a* and 12*b*. The actuating element 10 can be securely supported by the arrangement shown in FIGS. 12*a* and 12*b*, in particular of the handle 50 and of the housing element 20. No mechanical forces act onto the sealing element 30 in the non-actuated state. The housing element 20 and the housing floor 23 are held in their position by the handle 50. Also the actuator 40 is fixed at the handle 50 by this arrangement.

A further advantage of the device of the present invention becomes clear from FIGS. 13*a* and 13*b*. No overload forces from the actuator 40 can be transferred to the actuating element 10 since the actuator 40 came to rest already earlier at the housing element 20 in the present arrangement of the housing element 20, of the actuator 40, of the handle 50 and of the sealing element 30. The damaging of the actuating element 10 by overload forces, which act on the actuator 40, is thereby avoided.

Finally it is pointed out that the here illustrated embodiment forms are only examples of realizations of the invention. Nevertheless changes and modifications are possible.

LIST OF REFERENCE NUMERALS

10 actuating element
11 electrical conductor
12 counter holding means
13 interior of 10
14 outer side
20 housing element
21 key board plate
22 sealing projection, rib
23 housing floor

24 device unit
25 holding support
26 guides at 20
27 counter guide at 23
28 clip element
30 sealing element
31 slot
32 opening for 11
33 upper side of 30
34 cam
40 actuator
41 holding means
42 surface of 40
43 stabilization device component
44 shifting direction
50 handle
51 clip connection at 50

The invention claimed is:

1. Handle for doors or panels, in particular at vehicles, with an actuating element (10) such as a key board or a switch, wherein the actuating element (10) is integrated into the handle (50) and which exhibits an elastic sealing element (30) in regions and at least a form stable housing element (20), comprising a key board plate (21) with at least one sealing projection (22) is furnished, wherein the sealing projection (22) can be brought in operating connection with an elastic sealing element (30) such that the sealing projection (22) at least in regions penetrates into material of the sealing element (30) and thereby seals the interior (13) of the actuating element (10) relative to the outer side (14), wherein an actuator (40) is furnished, wherein the actuating element (10) can be manually actuated through the actuator (40), wherein the sealing element (30) is disposed between the actuator (40) and the actuating element (10) in the mounted state.

2. Handle according to claim 1, characterized in that a housing floor (23) is furnished, which housing floor (23) secures the operating connection between the sealing element (30) and the sealing projection (22).

3. Handle according to claim 2, characterized in that the operating connection between the sealing element (30) and the sealing projection (22) is obtained by the mounting of the housing floor (23).

4. Handle according to claim 2, characterized in that the housing floor (23) is supported at the housing element (20), and in particular disengageably supported, preferably by way of a snap-in, clip, or plug connection or by insertion under intermediate position of a guide (26) at the housing element (20) and a counter guide (27) at the housing floor (23).

5. Handle according to claim 1, characterized in that the sealing projection is formed as at least one and preferably two circulating ribs (22).

6. Handle according to claim 1, characterized in that the actuating element (10), the housing floor (23), the casing element (20), and the key board plate (21) form a device unit (24).

7. Handle according to claim 1, characterized in that electrical conductors (11) are furnished, through which the signals generated by the actuating element (10) can be further conducted to a control unit, wherein the conductors (11) can be arranged at least in regions in a holding support (25), which is preferably formed by the housing element (20) and the key board plate (21).

8. Handle according to claim 1, characterized in that the actuator (40) exhibits holding means (41) and the actuating element (10) exhibits counter holding means (12), which cooperate in the mounted state in order to avoid an unintentional shifting (44) of the actuator (40), wherein the holding means (41) or, respectively, the counter holding means (12) can be formed as a single piece with the actuator (40) or, respectively, the actuating element (10) and/or the counter holding means (12) are furnished preferably at a cam (34) at the upper side (33) of the sealing element (30).

9. Handle according to claim 8, characterized in that a stabilization device part (43) is furnished, which is in an intermediate position to the operating connection between the holding means (41) and the counter holding means (12).

10. Handle according to claim 1, characterized in that the housing element (20), the housing floor (23) and/or the device unit (24) are connectable, in particular disengageably connectable with the handle (50) by way of a snap-in, plug, or clip connection (51), wherein preferably a clip element (28) is furnished at the housing element (20) and/or at the housing floor (23).

11. Handle according to claim 1, characterized in that the housing element (20), the housing floor (23) and/or the device unit (24) are held in their position through the handle (50) in the mounted state.

12. Handle according to claim 1, characterized in that the actuator (40) and the actuating element (10), the housing element (20) and/or the device unit (24) are arranged such that no mechanical overload of the actuating element (10) can be exerted by an actuation of the actuator (40).

13. Handle according to claim 1, characterized in that the handle (50) and/or the actuating element (10) operates on a closure system at the vehicle upon their manual actuation, which closure system serves for opening, closing, bolting and/or unbolting of a lock at the door or, respectively, at the flap of the vehicle.

14. Handle according to claim 1, characterized in that the actuating element (10) and/or the actuator (40) exhibit several actuating regions (42), wherein different actuating regions trigger different functions at the vehicle or, respectively, at the locking system upon actuation.

15. Handle according to claim 1, characterized in that the actuator (40) and/or the housing element (20) and/or the key board plate (21) and/or the housing floor (23) consists of plastic, in particular out of a form stable plastic.

* * * * *